United States Patent [19]

Robinson

[11] 3,993,921

[45] Nov. 23, 1976

[54] PLASMA DISPLAY PANEL HAVING INTEGRAL ADDRESSING MEANS

[75] Inventor: Frank Neville Hosband Robinson, Rumson, N.J.

[73] Assignee: Bell Telephone Laboratories, Incorporated, Murray Hill, N.J.

[22] Filed: Sept. 23, 1974

[21] Appl. No.: 508,097

[52] U.S. Cl. ..... 313/188; 313/201; 313/217; 313/220

[51] Int. Cl.[2] ..... H01J 61/067; H01J 61/30; H01J 61/54

[58] Field of Search ..... 313/188, 201, 217, 220; 315/169 TV

[56] References Cited

UNITED STATES PATENTS

| | | | |
|---|---|---|---|
| 3,603,836 | 9/1971 | Grier | 313/201 |
| 3,716,742 | 2/1973 | Nakayama et al. | 313/188 X |
| 3,806,760 | 4/1974 | Shimada | 315/169 TV |
| 3,811,062 | 5/1974 | Andoh et al. | 313/188 |
| 3,846,656 | 11/1974 | Schermerhorn | 313/188 |
| 3,863,090 | 1/1975 | Pennebaker, Jr. | 315/169 TV X |

*Primary Examiner*—Palmer C. Demeo
*Attorney, Agent, or Firm*—William Ryan; Ronald D. Slusky

[57] ABSTRACT

A plasma display panel incorporates a portion of the cell-addressing logic by associating with each row and column of a rectangular array a plurality of conductors which are selected by coded addressing signals. The coincidence or lack of coincidence of an appropriate pattern of such signals at each cell, as averaged by one or more conducting cover segments at each cell, selectively produces a potential suitable for initiating or extinguishing a gas discharge. A result of this structure is a reduction in the total number of, and complexity of, external drive circuits while retaining a direct write capability for each individual cell.

4 Claims, 11 Drawing Figures

PLASMA DISPLAY PANEL HAVING INTEGRAL ADDRESSING MEANS

BACKGROUND OF THE INVENTION

1. Field of the Invention

The present invention relates to display devices and, more particularly, to plasma discharge display devices. Still more particularly, the present invention relates to a plasma discharge panel having a reduced number of external drive lines and associated drive circuits.

2. Prior Art

U.S. Pat. No. 3,559,190 issued to D. L. Bitzer et al on Jan. 26, 1971, and U.S. Pat. No. 3,499,167 issued to T. C. Baker et al on Mar. 3, 1970, typify the display device commonly known as the plasma panel. Such panels typically include a plurality of individual gas discharge sites or cells defined by the intersection of horizontal and vertical conducting lines placed on either side of a sandwich arrangement including parallel dielectric layers enclosing an ionizable gas. The effect, then, is to define by the intersection of the conductors a rectangular matrix of gas discharge cells. For the case where there are R rows and C columns there are therefore a total number of $R \times C$ individual gas discharge cells.

A considerable portion of the expense in manufacturing plasma panels has been found to be the drive circuitry for applying pulse or sinusoidal signals to the individual row and column conductors associated with a plasma panel. The drive circuits include means for establishing, maintaining and terminating plasma glow discharges at each of the cells. In general, a separate driver is provided in the prior art for each row and each column in the array. A number of attempts have been made to simplify the drive circuitry associated with plasma panels. See, for example, W. E. Johnson et al, "A Quarter-Million-Element AC Plasma Display with Memory" and G. W. Dick, "Low Cost Drivers for Capacitively Coupled Gas Plasma Display Panels," both appearing in *Proceedings of the SID*, Vol. 13, No. 1, First Quarter 1972; and U.S. Pat. No. 3,689,912 issued to G. W. Dick on Sept. 5, 1972.

Another technique common in addressing memory arrays, e.g., may also be used to some advantage in addressing plasma panels. In particular, matrix cross-point selection structures useful in some applications are described in U.S. Pat. No. 3,665,400 issued May 23, 1972 to D. D. Leuck.

Still another plasma panel addressing scheme involves the application of additive and subtractive pulses to selected and non-selected plasma cells. Such techniques are described, e.g., in T. N. Criscimagna, "Additive Pulses 'Turn On' Display Cells — Reliably," *Electro-Optical Systems Design*, Aug. 1971, pp. 32–37.

One effort to simplify the addressing requirements for a plasma panel by partial decoding at the plasma display sites, i.e., per cell partial decoding, is described in J. D. Schermerhorn, "Internal Random Access Address Decoding in AC Plasma Display Panel," *Digest of Technical Papers* 1974 *SID International Symposium*, May 1974, pp. 22–23. The per cell partial decoding described in this latter paper, however, is based on a selective erase process; no direct writing (initiating of a glow discharge) at individual cells is possible using the Schermerhorn technique. Another useful reference directed to plasma panel access circuitry simplification is U.S. Pat. No. 3,824,580 issued July 16, 1974 to C. R. Bringol.

It is, therefore, an object of the present invention to provide a plasma panel having a decreased number of external drive lines and, consequently, a reduced number of associated drive circuits.

It is a further object of the present invention to provide for individual direct addressing (writing or erasing) at each individual display site.

SUMMARY OF THE INVENTION

In typical embodiment the present invention provides for accessing a single line (row or column in a rectangular matrix) by a plurality of subline selection signals. Thus, for example, by applying two separate selection signals to sublines of the type described in the Schermerhorn patent, supra, which signals are effectively averaged by the presence of a so-called cover element, the direct selection for write or erase purposes is provided for by decoding within a plasma panel. The cover segment is typically embodied within the dielectric layer covering the electrodes (here the sublines) and juxtaposed with a panel substrate.

Subline addressing may be accomplished in both the X and Y planes of the plasma panel. While two sublines may be used per element to great advantage, in general any number of sublines may be used.

Though the use of the modifications to the panel structure described, for example, in the Schermerhorn paper, supra, while overcoming the limitations to erase only and electronic inversion, it proves possible in the present invention to effectively reduce the number of input lines to the panel from 2L to $4L^{1/2}$ or for an $L \times L = 256 \times 256$ panel from 512 to 64.

DETAILED DESCRIPTION

U.S. Pat. No. 3,499,167 issued Mar. 3, 1970 to T. C. Baker et al, which is hereby incorporated by reference, describes the structure for a typical plasma panel and the individual cells contained therein. Further details of typical plasma cell structure and functioning will also be found in the paper by R. L. Johnson et al entitled "The Device Characteristics of the Plasma Display Element," *IEEE Transactions on Electron Devices*, Vol. ED-18, No. 9, Sept. 1971, pp. 642–649, which paper is also hereby incorporated by reference. The Leuck patent, supra, is also incorporated by reference.

Figure 1:
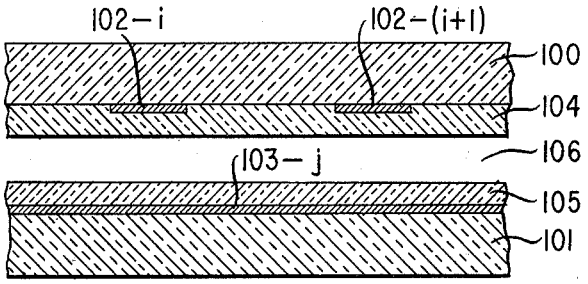
FIG. 1 (PRIOR ART)
FIG. 1 shows a prior art plasma panel construction.

FIG. 1 is a representation, in cross section, of typical prior art plasma cells in an array like that described in the Baker et al patent and Johnson et al paper incorporated herein. As will be noted in FIG. 1, the structure is basically a "sandwich" including main structural (typically glass) substrates 100 and 101 on which are placed respective sets of X and Y conductors, 102-*i* ($i = 1,2, \ldots ,M$) and 103-*j* ($j = 1,2, \ldots ,N$). Overlaying the conductors 102-*i* and 103-*j* are respective dielectric layers 104 and 105 which serve, inter alia, to protect the conductors and contribute to the cell memory facility. An ionizable gas, typically a mixture including approximately 97 percent neon and 3 percent nitrogen, is also contained in the sandwich and is represented in FIG. 1 by the numeral 106.

An individual plasma discharge cell is defined in the structure of FIG. 1 by the overlapping of the orthogonal conductors, e.g., 102-*i* and 103-*j*. When appropriate pulse or sinusoidal write signals, well defined in the prior art, are applied to selected ones of the overlapping conductors, a discharge occurs in the gaseous atmosphere between these selected conductors. Because of the well-known memory facility of AC plasma panels, a discharge once commenced by a write signal of a given amplitude (typically 150 volts) may be periodically maintained by sustain pulse sequences of lower amplitude and longer duration or lower amplitude sinusoidal signals. An "on" cell, one in which a discharge had previously been established and sustained, can be restored to the quiescent or "off" state by the application of an erase signal. The erase signal (for pulse operation) typically has a magnitude similar to the sustain signals, but has shorter duration.

Figure 2:
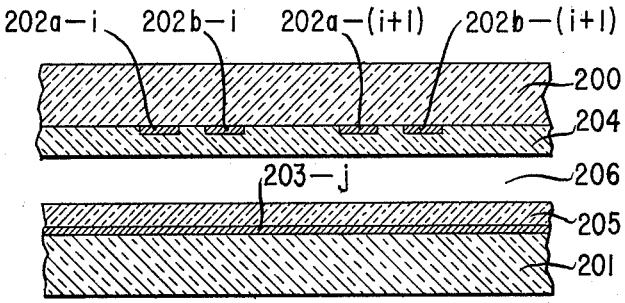
FIG. 2 (PRIOR ART)
FIG. 2 shows a modification of prior art panels utilizing a pair of sublines to define a single row or column.

FIG. 2 shows another panel structure described in the Schermerhorn paper, supra. The similarity to the structure of FIG. 1 is clear, but it should be noted that the top conductors 102-*i* in FIG. 1 are replaced by a bifurcated structure in FIG. 2 which includes separate conductors 202*a–i* and 202*b–i*. These latter conductors are substantially identical as regards their effect on the particular cell with which they are associated in pairs. As shown in FIG. 2, the conductor pair including conductors 202*a–i* and 202*b–i* interacts with only a single lower conductor 203-*j* in defining a discharge site or cell. As noted by Schermerhorn, however, the lower conductor 203-*j* may also be bifurcated to, in effect, define four subcells for each functionally independent cell, i.e., for each so-called resolution cell.

Because of the close coupling between each of the subcells described in the Schermerhorn paper, it is not possible to sustain in the on state any less than all of the four subcells. Thus, e.g., though it is possible to erase temporarily only one of the subcells, this subcell will be reignited upon sustaining one or more of the other subcells in the same resolution cell. No direct individual cell writing function is possible in the Schermerhorn structure, though direct erase is possible. Instead of directly writing a cell, the Schermerhorn system requires first that an "electronic inversion" of all cell states be accomplished, followed by a selective erase and a second inversion.

Since the coupling between discharges at electrodes defining subcells in the Schermerhorn structure is the basic cause for requiring the complex control circuitry used there, a further examination of this general coupling phenomenon is warranted. Instead of considering the exact structure of Schermerhorn, however, it proves convenient to treat a somewhat more generalized arrangement which is more amenable to analysis.

Figure 3:
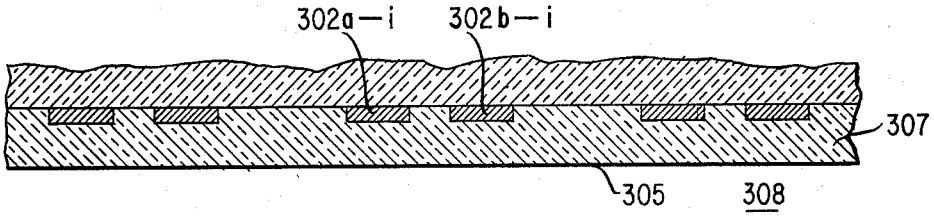
FIG. 3 shows a subline structure useful in explaining the principles of the present invention.

It is well known in the plasma display arts that panel discharges are controlled by the potentials at the surface of the dielectric layers covering the conducting lines on the panel substrate. For a given dielectric layer, this potential is in turn controlled by the charge accumulated during a discharge and the potential applied to the line. It might be supposed that if, as in FIG. 3, we subdivided each original line into two parallel, narrower sublines 302*a–i* and 302*b–i*, the potential at a point 305 in the gaseous atmosphere 308 on the surface of dielectric layer 307 would be approximately the average of the potentials applied to each subline. If this were the case, then a particular line could be selected by exciting both its sublines and the lines with only one excited subline (or no sublines excited) would not be selected. This is unfortunately not the case.

Figure 4:
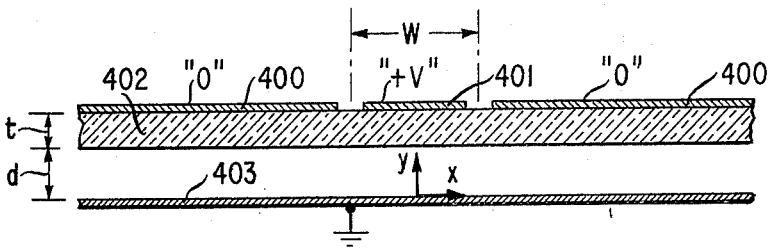
FIG. 4 shows a hypothetical structure useful for evaluating electric fields within a plasma panel.

In FIG. 4 one subline 401 of width $w$ is shown maintained at a potential +V in a slot in a guard plane 400 maintained at zero potential. This plane is covered by a dielectric layer 402 having a dielectric constant $\epsilon$ and faces (across a gaseous atmosphere having a dielectric constant of 1) a conducting plane 403, also at zero potential. Clearly the guard plane 400 will exert more of an influence on the potential at a point on the surface of the dielectric 402 opposite the live line 401, than would be produced by a single neighboring subline at ground potential. In the case shown in FIG. 4 the potential at the dielectric surface above the center of the line, i.e., at $x = 0$ and $y = d$ can be shown to be $$\Phi = \frac{2v}{\pi} \int_0^\infty \frac{1}{\cosh 2\pi kt \left[1 + \frac{1}{\epsilon} \frac{\tanh 2\pi kt}{\tanh 2\pi kd}\right]} \frac{\sin \pi kw \, dk}{k}$$

The difference between the line potential V and the potential $\Phi$ at the surface of the dielectric is readily shown to satisfy $$\frac{V - \Phi}{V} < \frac{1}{\epsilon + 1} \left\{1 - \frac{2}{\pi} \arctan (\exp w/2t)\right\}$$

Since, in a typical case, $w \sim 5$ mil. and $t \sim 1$ mil the term in the brackets is approximately 0.05, and so $$\frac{V - \Phi}{V} < \frac{1}{\epsilon + 1} + 0.1.$$

The value of the dielectric constant $\epsilon$ is likely to exceed 5 and so the presence of the guard plane 400 only reduces the potential above the center of the live line by 25 percent or so. In other words it has a rather small effect. If, instead of a single live line and an extended guard plane, there were only two closely spaced lines the effect of one line on the potential above the other line would be even less than this rough estimate. Thus if one of the sublines is taken to be at write potential, holding the other subline at ground potential is unlikely to inhibit the initiation of a discharge. The two subline scheme is, therefore unlikely to be of any practical value for purposes of achieving direct selective writing of a plasma cell.

Figure 5:
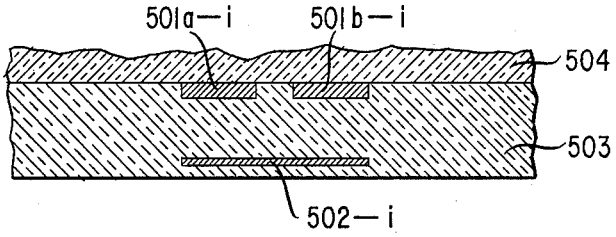
FIG. 5 shows a modified plasma panel construction in accordance with the present invention which includes, in addition to the two subline structure of FIGS. 2 and 3, a cover element which provides an averaging function for the field adjacent the dielectric layer surface.
Figure 6:
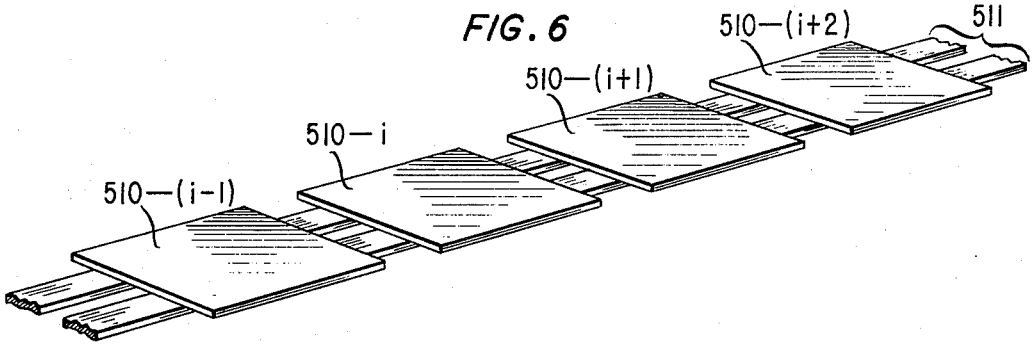
FIG. 6 shows a typical construction for a cover element in which one segment is associated with each cell along a row or column in a plasma panel.

FIG. 5 shows an improvement to the above-described 2-subline structure which permits the desired selective cell operation. In particular, FIG. 5 shows a single panel line divided into two sublines 501*a–i* and 501*b–i*, but now a further layer of metallization 502-*i*, substantially equal in width to the original line, is deposited within the dielectric layer 503 above the sublines, i.e., between the sublines and the gas. As before, the conductors and dielectric layer 503 are placed on a dielectric substrate 504. In this case, if the sublines 501*a–i* and 501*b–i* are taken to voltages $V_1$ and $V_2$, respectively, the "cover line" 502-*i* will be taken to very nearly the average potential ½ $(V_1+V_2)$. Since this cover line 502-*i* determines the potential at the dielectric-gas interface, and so controls the discharge, coincident addressing is possible. If C′ is the capacitance between each of the sublines 501*a–i* and 501*b–i* and the cover line 502-*i*, it can be shown that orthogonal sets of structures like those shown in FIG. 6 are functionally equivalent to (though structurally very different from) a simple resistor coincidence array (with each resistor replaced by C′) or to the apparatus described in the Bringol patent, supra. It should be understood, of course, that the subline pair 501*a–i* and 501*b–i* and the associated cover line 502-*i* shown in FIG. 5 are replicated for each row, say. As desired, the counterpart column (or other orthogonal) structure to define an individual cell can include substantially similar elements or simply a standard single electrode as described, e.g., in the Baker et al patent, supra.

As illustrated in FIG. 5, the cover line 502-*i* floats, i.e., is not conductively tied to any potential source. The result of this is that the potential assumed by the cover line during the sustain phase, when both sublines are taken to the sustain potential, is likely to vary rather erratically as the number of illuminated cells defined in part the line varies. There is, however, no reason why the cover line need be continuous, i.e., a common cover "line" need not be provided for all cells along a line defined by conductors 501*a–i* and 501*b–i*. The cover element is only needed to average the two subline potentials at the site of an individual cell, where the line shown in FIG. 5 crosses over a line on the opposite face of the panel.

Thus, as shown in FIG. 6, the cover line of FIG. 5 can be divided into L segments 501-*i*, $i = 1,2,\ldots,L$, one for each cell along a subline pair 511. A system based on the structure shown in FIG. 6 is functionally similar to a capacitive coincidence array in which the series capacitive elements are provided on a per-element basis rather than a per-line basis. If the sublines are driven by a low impedance source, the potential at each cell is substantially independent of the state of the discharge at all the other picture elements on the line defined by a common pair.

Figure 11:
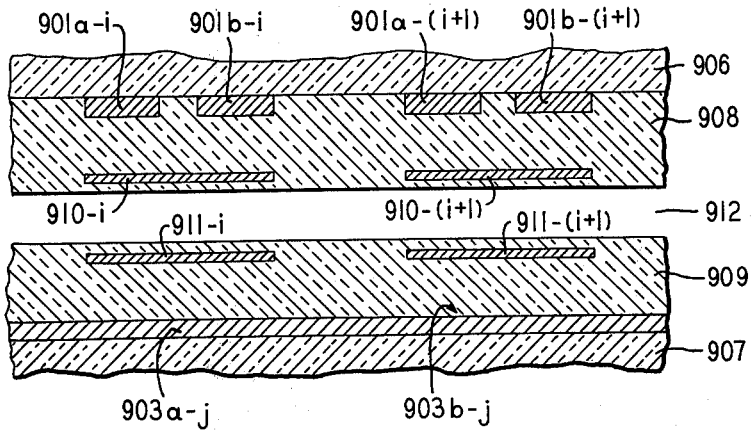
FIG. 11 shows a modified plasma panel construction in accordance with the present invention which includes cover elements for both row and column sublines.

A display structure employing floating cover elements in accordance with the invention for both row and column subline pairs is shown in FIG. 11. In particular, row conductor pairs 901*a–i* and 901*b–i* ($i = 1, 2, \ldots, M$) are disposed on substrate 906, covered by dielectric layer 908. A similar plurality of column conductor pairs 903*a–j* and 903*b–j* ($j = 1, 2, \ldots, N$) is disposed on substrate 907 covered by dielectric layer 909. (Only one 903*a–j* column conductor is visible in FIG. 11.) In accordance with the invention, cover elements 910-*i* and 911-*i* are deposited within dielectric layers 908 and 909, respectively. A layer of ionizable gas sandwiched between dielectric layer 908 and 909 is represented by the reference numeral 912.

During the time when a sustain pulse is applied to a rectangular orthogonal array of line-cover segments structures like those shown in FIG. 6 (and FIG. 5 if 502-*i* is taken as one cover segment) when all the pairs of sublines are driven together, the cover segments play almost no role. Indeed, if 502-*i* is a cover segment and if the total thickness of dielectric layer 503 in FIG. 5 is the same as in the original (Baker et al-type) panel, conditions during the sustain phase will also be the same. It is not necessary, therefore, to consider the effect of the cover segments, on the sustain phase of the complete panel cycle. The cover segments are important in contributing their voltage-averaging functions only during the write and erase phases.

It will be appreciated that in selecting a given row (or column) of cells in a rectangular array based on the two-subline structure of FIGS. 5 and 6, it is necessary that a two-input signal be provided. Thus, e.g., the connection pattern shown in FIG. 7 may advantageously be used to select a particular one of 16 lines (16 pairs of sublines) for writing by concurrently applying, say, voltages of $+V_{ww}$ on one of the lower input leads 701-*i*, $i = 1,2,3,4$, and one of the upper input leads 702-*i*, $i = 1,2,3,4$. The unselected leads are, of course, maintained at ground or other reference level. Though those cells receiving a voltage of $+V_{ww}$ from only one of the leads 701-*i* or 702-*i* will not initially ignite (for properly chosen values of the write voltage, $V_{ww}$), inadvertent erasing of on cells by such a single +V signal are more likely. Accordingly, the inputs not associated with a cell to be selected are advantageously held at a voltage $-V_{oo}$, where ½ $(V_{ww} - V_{oo})$ is insufficient to cause inadvertent erasure.

Figure 7:
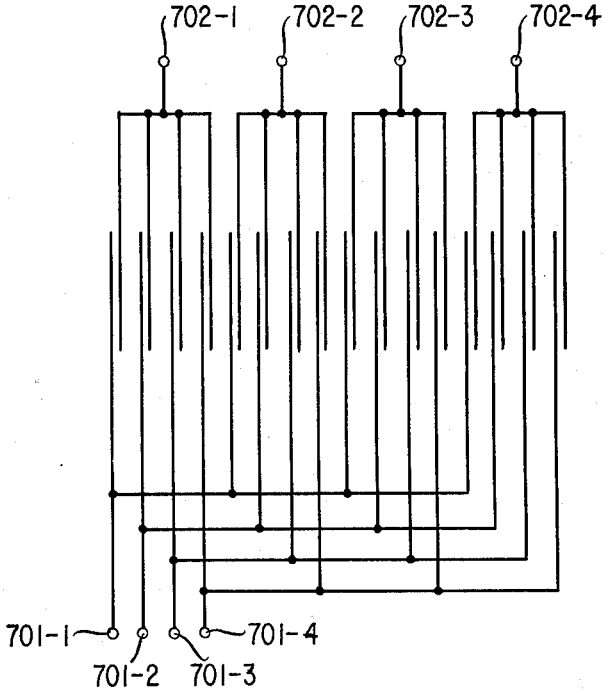
FIG. 7 shows the manner in which a 16 row (or column) plane in a plasma panel may be addressed using the subline structure of FIGS. 5 and 6.

Each input, e.g., 701-*i* and 702-*i* in FIG. 7, to a panel based on the electrode and cover element structures of FIGS. 5 and 6 must, of course, be excited at the appropriate time in a complete pulse cycle with the voltages needed to sustain, erase and write. The voltages mentioned above which are useful in holding off half-select voltages on unselected lines during the write phase must also be provided. Again it is noted that the pattern of FIG. 7, for example, represents only one plane, say the X plane of the usual sandwich matrix structure. Another plane (the Y plane based on the last assumption) also requires substantially identical structure. Each of the X and Y inputs, in general, requires sustain voltages of both polarities, but write and erase voltages of one polarity, and hold-off voltage of the opposite polarity, will generally suffice for a given (X or Y) plane. Complementary voltages are, however, requires by the two planes to effect the usual algebraic sum of voltages between the two planes. It is also desirable that, between pulses, the inputs be returned to ground potential.

Figure 8:
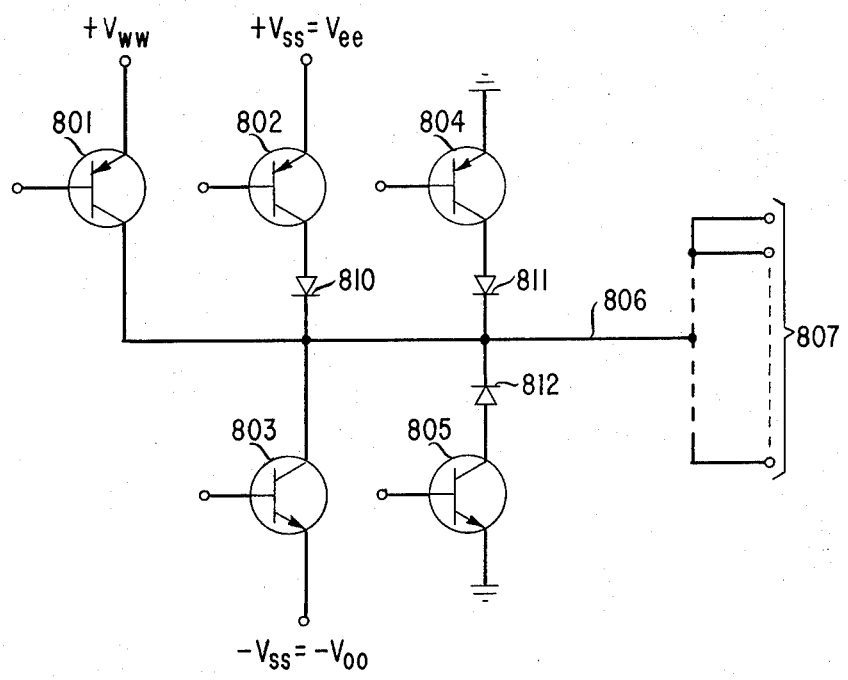
FIG. 8 shows a simple drive circuit suitable for connection to an input line in an addressing plane such as that shown in FIG. 7.

One simple circuit for achieving this set of conditions when connected to each input terminal of a plane is shown in FIG. 8. The required control signals are essentially identical to these described in the Baker et al patent and known generally in the art, except that the decoded address signals are used to select not a single line, but one each of the sets of sublines such as 701-*i* and 702-*i* in FIG. 7. Transistor 801 in FIG. 8 supplies the write pulse, transistor 802 the positive sustain and erase pulses, and transistor 803 the negative sustain and hold-off pulses to input lead 806. Transistors 804 and 805 return the input to ground after negative or positive excursions. The diodes 810–812 prevent reverse bias signals from reaching the transistors. Note that each input node 806 is connected to a plurality of sublines 807.

Figure 9:
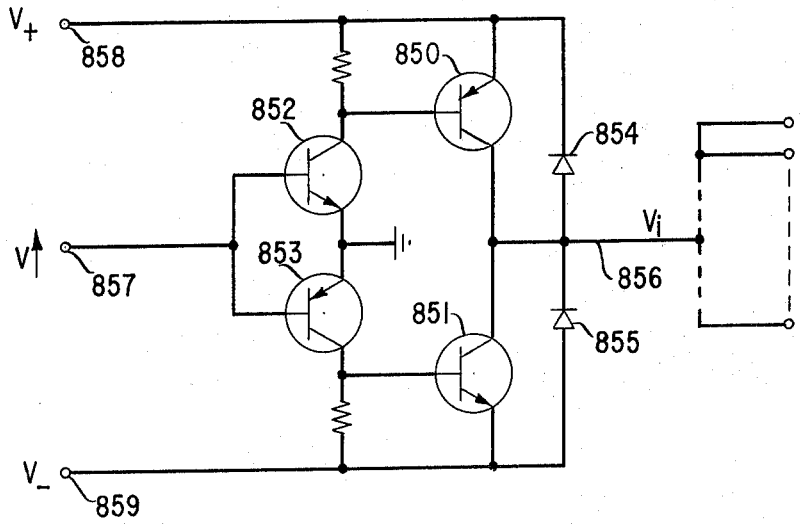
FIG. 9 shows a modified drive circuit having improved performance relative to that of FIG. 8.

FIG. 9 shows an improved drive circuit suitable for connection to a panel line input. In FIG. 9 four transistors, and two diodes, 854 and 855, are used as a single-pole, two-way switch, to connect an input node 856 to either a positive pulse-rail 858 when the input $v$ at terminal 857 is positive or a negative pulse rail 859 when $v$ is negative. The appropriate sequence of pulses, shown in FIG. 10 and discussed below, on each of the two rails is readily provided in standard fashion, e.g., by two master pulse generators for the whole X plane. The addressing transistors 850–853 thus are not longer used to control the pulse shapes. The diodes 854 and 855 prevent the input potential $V_i$ at node 856 from being either more positive than the positive pulse rail or more negative than the negative pulse rail. Thus, when both pulse rails are at ground potential, the input will be held at, or near, ground potential.

Figure 10:
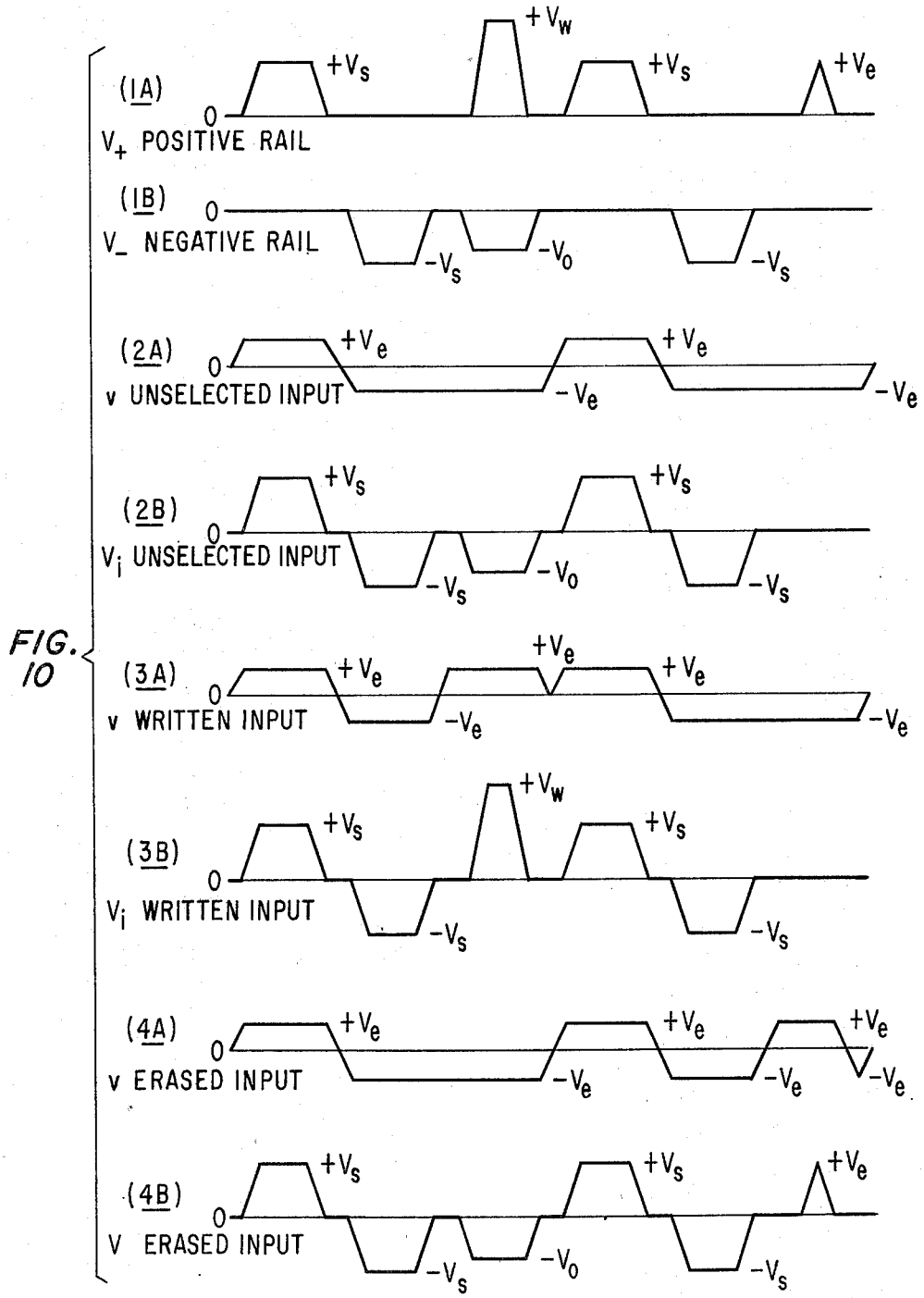
FIG. 10 shows waveforms associated with the drive circuit of FIG. 9.

FIG. 10 shows, in lines 1A and 1B, the pulse trains in respective pulse rails 858 and 859, where $V_s$ is the normal sustain potential, $V_w$ the write potential and $V_e$ the erase potential. The pulse sequence supplied to the enabling terminal 857 of an unselected (no write or erase) input is shown in line 2A and the resulting pulse train at the input terminal 856 is shown in line 2B. Lines 3A, 3B and 4A, 4B, respectively, show the corresponding pulse trains for inputs selected for either writing or erasing. By placing negative write pulses on the negative pulse rail and positive hold-off pulses on the positive pulse rail the same system can be used with a different polarity writing scheme. Note that current gain is provided, on each polarity pulse, by a pair of transistors 850, 851 or 852, 853 and the enabling voltage need only be a few volts relative to ground. Thus the enabling input will be at a low level and can be provided by existing integrated logic circuits.

Construction of the addressing planes of the type illustrated in FIGS. 5–7 may be effected in any standard fashion. For example, thick-film techniques described in "Thick Film Materials for Electro-Optical Applications," by S. J. Stein, *Proc.* 1972 *Electronic Components Conference*, Washington, D.C., May 15–17, 1972 may be used in fabricating the layers and segments corresponding to the above described structure. Typical materials to be used include substrate — Forsterite ceramic (or glass)
dielectric layers — ESL No. 4608 dielectric coating
electrodes — thick film gold, ESL 8835, where those materials denoted by ESL numbers are available from Electroscience Laboratories, Pennsauken, New Jersey. A typical gas mixture which has proved useful is one including 99 percent neon and 1 argon at a pressure of 500 mm Hg.

Other useful methods of fabrication and useful materials will occur to those skilled in the art in light of the prior art, including the Baker et al patent incorporated herein. Also of interest in this regard is U.S. patent application Ser. No. 444,380, by G. W. Dick et al, filed Feb. 21, 1974, which application is hereby incorporated by reference.

While the size of the cover segments will be tailored to the cell size and spacing in an obvious manner, a desirable cover segment size will range from 5 mils on a side to 50 mils on a side (depending on the subline width), with a typical spacing between a cover element and the underlying sublines being 1–2 mils, and the spacing between X and Y planes being typically 3–10 mils. Useful operating potentials for applying waveforms like those shown in FIG. 10 are $V_s = 125–150$ volts
$V_w = 160–220$ volts
$V_e = 70–100$ volts
$V_o = 0–90$ volts.

As will be appreciated from the above description, the present inventive structure permits a reduction in the number of panel addressing lines for an $L \times L$ panel from $2L$ to $4L^{1/2}$, e.g., from 512 to 64 for a $256 \times 256$ panel. Since the interconnections between sublines in the coincidence array need only be low resistance conducting paths, they may be incorporated as part of the panel structure. The number of external connections to the panel is therefore similarly reduced by use of the present invention.

While, for purposes of reducing external connections, the optimum arrangement for interconnecting sublines is that shown in FIG. 7, other particular interconnection patterns may be used. Thus, for example, 8 sets of sublines, each set including two sublines, can be used to address a line on a 16-line plane. While 10 external inputs are then required, the number of intra-panel crossovers is thereby reduced.

Further, while structures described above have emphasized a two-subline-per-line relation, more than two sublines may be used in appropriate cases. Thus even further per-cell decoding may be used, thereby reducing still further the required number of external connections to the panel.

Though the substitution of two sublines (with appropriate cover segments) for a single addressing line in a single addressing plane has been emphasized, it should also be understood that each line in each plane (typically X or Y) used in the otherwise usual sandwich construction can be so modified if desired.

What is claimed is:

1. A plasma display panel comprising first and second substantially parallel planar dielectric layers, a volume of an ionizable gas between said dielectric layers, first and second orthogonal pluralities of conductors disposed on opposite sides of said volume and substantially in respective first and second conductor planes, each of said conductor planes being substantially parallel to said first and second dielectric layers, selected ones of each of said first plurality of conductors being electrically interconnected to form respective subsets of conductors, each of a plurality of cylindrical volumes with generatrix perpendicular to said dielectric layers and including at least two conductors from said first plurality of conductors and at least one conductor from said second plurality of conductors, adjacent portions of said first and second dielectric layers, and the gas contained therebetween constituting a separately addressable plasma cell, and means at each cell for averaging a potential applied to said gas by said conductors from said first plurality of conductors.

2. Apparatus according to claim 1 wherein said means for averaging comprises a substantially planar conducting element placed intermediate said conductors included in said first plurality and said gas.

3. A plasma display panel comprising first and second substantially parallel planar dielectric layers, a volume of an ionizable gas between said dielectric layers, first and second orthogonal pluralities of conductors disposed on opposite sides of said volume and substantially in respective first and second conductor planes, each of said conductor planes being substantially parallel to said first and second dielectric layers, selected ones of each of said first plurality of conductors being electrically interconnected to form respective subsets of conductors, each of a plurality of cylindrical volumes with generatrix perpendicular to said dielectric layers and including at least two conductors from said first plurality of conductors and at least two conductors from said second plurality of conductors, adjacent portions of said first and second dielectric layers, and the gas contained therebetween constituting a separately addressable plasma cell, and first and second means at each cell for averaging a potential applied to said gas by said conductors from said first and second pluralities of conductors.

4. Apparatus according to claim 3 wherein each of said means for averaging comprises a conducting element placed intermediate said gas and the conductors from a respective one of said first and second pluralities of conductors.

* * * * *